United States Patent [19]

Lersmacher

[11] Patent Number: 4,461,019

[45] Date of Patent: Jul. 17, 1984

[54] ROTARY-ANODE X-RAY TUBE

[75] Inventor: Bernhard Lersmacher, Aachen, Fed. Rep. of Germany

[73] Assignee: U.S. Philips Corporation, New York, N.Y.

[21] Appl. No.: 304,425

[22] Filed: Sep. 21, 1981

[30] Foreign Application Priority Data

Oct. 29, 1980 [DE] Fed. Rep. of Germany ..... 3040719

[51] Int. Cl.[3] ..... H01J 35/10

[52] U.S. Cl. ..... 378/125; 378/144

[58] Field of Search ..... 378/125, 129, 127, 144, 378/143; 313/355

[56] References Cited

U.S. PATENT DOCUMENTS

| | | | |
|---|---|---|---|
| 196,425 | 10/1877 | Brush | 313/355 |
| 3,539,859 | 11/1970 | Bougle | 378/129 |
| 3,934,164 | 1/1976 | Braun et al. | 378/144 |
| 4,392,238 | 7/1983 | Lersmacher et al. | 378/125 |

FOREIGN PATENT DOCUMENTS

| | | | |
|---|---|---|---|
| 2440988 | 3/1975 | Fed. Rep. of Germany | 378/144 |
| 2910138 | 9/1980 | Fed. Rep. of Germany | 378/144 |

*Primary Examiner*—Alfred E. Smith
*Assistant Examiner*—Carolyn E. Fields
*Attorney, Agent, or Firm*—Paul R. Miller

[57] ABSTRACT

A layer of pyrolytic graphite is deposited on the surface of the basic body of the anode of a rotary-anode X-ray tube. On the layer of pyrolytic graphite there is provided a further layer of a high-melting metal on the surface of which the focal path extends during operation of the tube. A basic body which has substantially all advantages of the pyrolytic graphite but whose manufacture is much simpler, faster and hence also more economical than an equivalent carrier body comprising a ring of solid, thick-walled pyrolytic graphite, is obtained in that the basic body consists of a lamination of graphite foils at least in the region beneath the focal path.

2 Claims, 3 Drawing Figures

ROTARY-ANODE X-RAY TUBE

Figure 1:
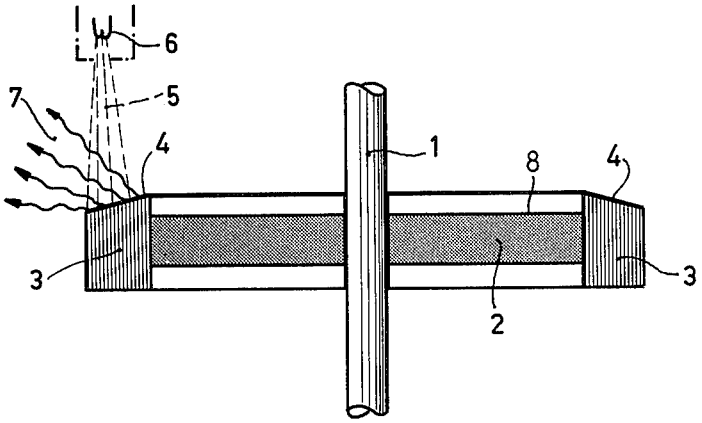

The invention relates to a rotary-anode X-ray tube, comprising an anode with a basic body which is made at least partly of carbon, a layer of pyrolytic graphite deposited on the surface of the basic body, and a further layer of a high-melting metal which is deposited on the layer of pyrolytic graphite and on the surface of which the focal path extends during operation of the tube.

A rotary anode comprising a basic body of graphite provided with a layer of pyrolytic graphite is known from German Offenlegungsschrift No. 21 46 918. The pyrolytic coating of this rotary anode serves to create smooth, dense surfaces so that no particles can become detached from the basic body. Due to the absence of pores, i.e. the impediment of the so-called outgassing, moreover, it is substantially easier to maintain a permanent high vacuum than in the case of uncoated graphite basic bodies. In order to improve the X-ray yield, in accordance with the above-mentioned Offenlegungsschrift it already suffices to provide only the focal path with a coating. In that case no loose particles can occur, so that the focal path properly adheres. Moreover, the pyrolytic coating results in a smooth surface on which a thin coating of metal is also smooth, so that the X-rays can readily emerge and the dose loss occurring from the roughnesses in uncoated graphite anodes is avoided. The problem concerning the dissipation of heat from the focal path is not dealt with in German Offenlegungsschrift No. 21 46 918.

From German Offenlegungsschrift No. 29 10 138 a rotary-anode X-ray tube is known which comprises a carrier body which can be connected to a shaft and which is connected to a ring of pyrolytic graphite which is arranged concentric to the axis of rotation, the surfaces of higher thermal conductivity in the ring extending parallel to the axis of rotation of the carrier body, the focal path being provided on an end face of the ring. The carrier body and the ring of pyrolytic graphite together form the basic body which, however, is not coated with pyrolytic graphite in the latter rotary anode. In the known rotary anode, the direction of high thermal conductivity of the anisotropic pyrolytic graphite is used for adequate dissipation of heat from the particularly highly loaded focal path. The tests underlying the present invention, however, have revealed that the fast dissipation of the heat loss produced in the focal path necessitates adequate conduction cross-sections in accordance with the heat conductivity equation. This means that the ring of pyrolytic graphite must be as thick as possible, so that layers of pyrolytic graphite have to be formed as thickly as possible. The minimum thickness is determined by geometrical factors. When the heat loss is optimally coupled into the highly conductive layers of the pyrolytic graphite, the layer thickness should amount to at least the width of the focal path, but preferably it should be wider. In practice this implies pyrolytic graphite layer thicknesses of at least 1 cm. The manufacture of solid pyrolytic graphite having such a thickness requires complex apparatus and long periods of time when conventional CVD techniques are used, for example, as known from Philips Technische Rundschau 37 (1977/78), 205–213. The growth rates are in the order of magnitude of from 2 to 10 μm/min., so a coating period of several hours is required for a layer thickness of 1 mm.

The invention has for its object to provide a basic body as a part of a rotary anode which offers substantially all advantages of the pyrolytic graphite but which can be manufactured much more simply, faster and hence also more economically than an equivalent carrier body comprising a solid ring of thick-walled pyrolytic graphite.

This object is achieved in accordance with the invention in that the basic body consists of a laminer arrangement of graphite foils at least in the region beneath the focal path.

Graphite foils are known from Angew. Chem. 12 (1970) 404–405. They are manufactured from so-called Graphit-Expandat without a bonding agent by rolling under high compression pressure. The basic material is formed by chemically expanding flakes of natural graphite. The expansion consists in an expansion of the layer structure of the graphite in the direction of the crystallographic c-axis to a multiple of the original thickness. Such graphite foils and laminations of such foils are commercially available (documentation "Sigraflex" from Sigri Elektrographit GmbH and "Papyer" of Le Carbone-Lorraine), inter alia a pronounced anisotropy of the physical properties is characteristic of such foils. Of these characteristics particularly, the high thermal conductivity parallel to the layer direction, i.e. to the foil surface, is important for the application in accordance with the invention. This conductivity amounts to approximately 1.5 W/cmK and thus reaches a value of approximately 50% of the thermal conductivity of suitably oriented pyrolytic graphite (2.5 to 4 W/cmK). The thermal conductivity of molybdenum, a customary material for rotary-anode discs, amounts to 1.4 W/cmK and that of tungsten to 1.3 W/cmK.

The values stated for the thermal conductivities of the graphite lamination on the one hand and pyrolytic graphite on the other hand correspond to the associated density values of approximately 1.0 g $cm^{-3}$ for the lamination and 2.0 to 2.2 g $cm^{-3}$ for pyrolytic graphite.

It may be assumed that a composite body consisting of graphite foils reinforced with an enveloping layers of pyrolytic graphite will have a thermal conductivity parallel to the layer direction which at least equals but is generally higher than that of conventional tungsten/-molybdenum composite anodes.

The basic body of a preferred embodiment in accordance with the invention consists of a carrier body on which a tape-like graphite foil is wound to a thickness which corresponds to at least the width of the focal path. The assembly is coated with a layer of pyrolytic graphite. The resultant composite body is subsequently provided with a focal path by deposition of, for example, tungsten.

In a further preferred embodiment in accordance with the invention, parts or segments which are cut from blocks which themselves consist of stacks of layers of graphite foil and an envelope of pyrolytic graphite are assembled to form an annular body which is combined with the carrier body, taking into account the preferred orientation, in order to form the basic body.

"Taking into account the preferred orientation" means that the annular body in the latter case is layered so that the direction of the preferred thermal conduction extends throughout radially, i.e. towards the axis of rotation and away from the axis of rotation, or tangentially to the axis of rotation from the top to the bottom and vice versa).

These two embodiments thus involve two anode types which differ in that in the former case the thermal conductivity is preferably tangential and axial, and in the second case it is preferably radial and axial.

From the circumstances described for the direction of preferred thermal conductivity it follows directly that the layer of a high melting metal whose surface forms the focal path during operation of the tube, is arranged on the end and/or bottom surface (circular ring surface) in the former case, while in the latter case arrangement on the outer cylindrical surface is also possible, depending on the type of tube.

The carrier body requires a material which is suitable for pyrolytic coating. Preferably, use is made of graphite, but also other materials which are capable of resisting high temperatures are also suitable, for example, special ceramic bodies or also high-melting point metals such as molybdenum.

The special advantages of the invention are:

(a) Due to the use of graphite foil, only short coating periods are required for the deposition of the pyrolytic graphite. As a result, the manufacture is substantially simplified.

(b) Material and manufacture can be modified in various ways, for example, for optimum dissipation of the heat loss from the endangered regions of the anode.

(c) On the basis of the reduced coating period mentioned in sub paragraph (a) and the low price of graphite foil, composite anodes comprising compact components of highly thermally conductive anisotropic types of graphite can be manufactured comparatively cheaply.

Figure 2:
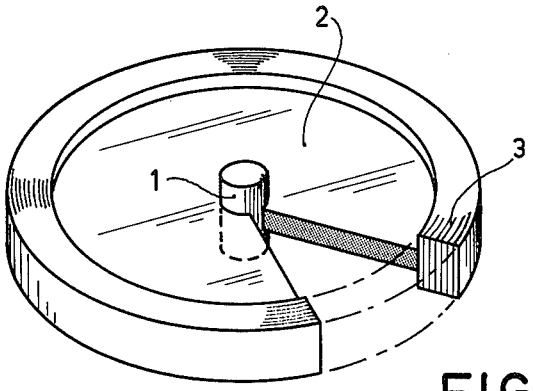
Figure 3:
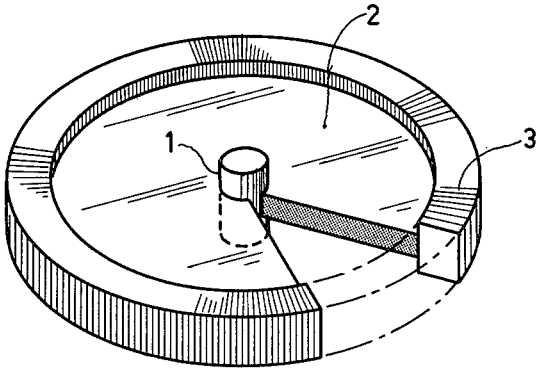

Some embodiments in accordance with the invention will be described in detail hereinafter with reference to a drawing wherein:

FIG. 1 is a sectional view of a rotary-anode X-ray tube during operation,

FIG. 2 and FIG. 3 each show a basic body of a rotary anode in a plan view and partly in a sectional view.

The rotary anode shown in FIG. 1 is secured to a rotating shaft 1. The basic body of the rotary anode consists of a carrier body 2 which is shaped as a circular disc and which is made of electrographite, and a ring 3 of stacked graphite foil, the ring 3 being arranged on the periphery of the carrier body 2. The basic body is enveloped by a layer of pyrolytic graphite 8 (shown in part). On this layer, an annular layer 4 of tungsten is provided over the ring 3. During operation of the X-ray tube, an electron beam 5 which is emitted by a cathode 6 is directed onto the layer 4, so that the layer 4 in its turn emits X-rays 7.

The manufacture of the basic body will be described in detail with reference to the FIGS. 2 and 3. In accordance with FIG. 2, a tape-like graphite foil 3 is wound onto carrier body 2 until the required thickness is reached. Subsequently, the assembly is provided with a coating of pyrolytic graphite (not shown), the duration of the coating operation depending on the required reinforcement. The shape of the resultant composite body is subsequently optimized by working (turning, grinding) for the coating with tungsten (by means of CVD or by soldering).

The basic body shown in FIG. 3 is manufactured as follows: The graphite foil is stacked and is reinforced to form blocks which are enveloped with pyrolytic graphite. From such blocks, parts or segments 3 are cut so that they can be combined, taking into account the preferred orientation, with a carrier body 2 in order to form a basic body.

What is claimed is:

1. A rotary anode x-ray tube comprising a basic body structure of at least partly carbon, a layer of pyrolytic graphite on the surface of said basic body structure, and a layer of a high-melting point metal on said layer of pyrolytic graphite, wherein said basic body structure includes a carrier body section and a ring section connected to said carrier body section, said ring section being a lamination of graphite foils, and wherein said carrier body section has a disk-like structure for rotation about an axis, and said ring section consists of a tape-like graphite foil wound about the periphery of said carrier body section to a thickness corresponding to at least a width of an electron beam focal path.

2. A rotary anode x-ray tube comprising a basic body structure of at least partly carbon, a layer of pyrolytic graphite on the surface of said basic body structure, and a layer of a high-melting point metal on said layer of pyrolytic graphite, wherein said basic body structure includes a carrier body section and a ring section connected to said carrier body section, said ring section being a lamination of graphite foils, and wherein said carrier body section is a disk-like structure for rotation about an axis, and said ring section consists of stacks of layers of said graphite foils provided in an annular body concentrically located around said carrier body section, said stacks of layers having a major surface parallel to said axis.

* * * * *